US009232577B2

(12) United States Patent
Ryu et al.

(10) Patent No.: US 9,232,577 B2
(45) Date of Patent: Jan. 5, 2016

(54) POWER DRIVER FOR LIGHT EMITTING DIODE ILLUMINATION AND CONTROL METHOD THEREOF

(71) Applicant: SAMSUNG ELECTRO-MECHANICS CO., LTD., Suwon-Si (KR)

(72) Inventors: Byoung Woo Ryu, Suwon-Si (KR); Jung Woo Choi, Suwon-Si (KR); Ki Hong Kim, Suwon-Si (KR)

(73) Assignee: Samsung Electro-Mechanics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 14/585,186

(22) Filed: Dec. 30, 2014

(65) Prior Publication Data

US 2015/0189707 A1 Jul. 2, 2015

(30) Foreign Application Priority Data

Dec. 31, 2013 (KR) ..... 10-2013-0168139

(51) Int. Cl.
*H05B 33/08* (2006.01)

(52) U.S. Cl.
CPC ..... *H05B 33/0806* (2013.01)

(58) Field of Classification Search
CPC .... H05B 37/02; H05B 33/08; H05B 33/0851; H05B 33/0887
USPC ..... 315/200 R, 201, 206, 279, 291, 297, 315/307, 308
See application file for complete search history.

(56) References Cited

U.S. PATENT DOCUMENTS

| | | | | |
|---|---|---|---|---|
| 8,901,843 | B2 * | 12/2014 | Jin et al. | 315/279 |
| 2005/0259448 | A1 * | 11/2005 | Koike | 363/21.01 |
| 2011/0260631 | A1 * | 10/2011 | Park et al. | 315/165 |

FOREIGN PATENT DOCUMENTS

| | | | |
|---|---|---|---|
| JP | 2013-511803 | | 4/2013 |
| KR | 10-2012-0135003 | | 12/2012 |
| WO | 2011/061633 | A1 | 5/2011 |
| WO | 2011/126106 | A1 | 10/2011 |

* cited by examiner

*Primary Examiner* — Thai Pham
(74) *Attorney, Agent, or Firm* — Ladas & Parry, LLP

(57) ABSTRACT

A method of controlling a power driver for LED illumination may include receiving, by a power correction unit, an AC voltage from the outside, rectifying the received AC voltage into a DC voltage, and correcting a power factor of the rectified DC voltage; and receiving, by a DC/DC converter unit, the DC voltage from the power factor correction unit and converting the received DC voltage into a DC voltage which has a magnitude different from the received DC voltage and is supplied to an LED module. A skip control unit, which is disposed in the DC/DC converter unit, may be fed back with a current flowing in the LED module driven by receiving the output from the DC/DC converter unit to detect a magnitude of the current and output a signal for a skip mode control depending on the detected magnitude of the current.

10 Claims, 5 Drawing Sheets

POWER DRIVER FOR LIGHT EMITTING DIODE ILLUMINATION AND CONTROL METHOD THEREOF

CROSS REFERENCE(S) TO RELATED APPLICATIONS

This application claims the benefit under 35 U.S.C. Section 119 of Korean Patent Application Serial No. 10-2013-0168139, entitled "Power Driver For LED (Light Emitting Diode) Illumination And Control Method Thereof" filed on Dec. 31, 2013, which is hereby incorporated by reference in its entirety into this application.

BACKGROUND

1. Technical Field

Some embodiments of the present disclosure relate to a power driver for light emitting diode (LED) illumination and a control method thereof, and more particularly, to a power driver for light emitting diode (LED) illumination and a control method thereof which may have a wide output voltage range by performing, for example, but not limited to, a skip mode control.

2. Description of the Related Art

A power driver for LED illumination may supply a constant current to an LED module by a control of current. In this case, an output voltage may be determined by a LED forward voltage Vf of the LED module. When Vf of the LED is out of the output voltage range of power, the current may not be controlled and thus the LED may not emit light.

The power driver for LED illumination constantly controls an output current in terms of characteristics of the LED module and the output voltage is designed to meet Vf of the LED module. If the output voltage range is narrow, as illustrated in FIG. 1, each of the power drivers 101*b* to 103*b* for illumination may need to be designed to correspond to each of the LED modules 101*a* to 103*a*. Therefore, the inconvenience that one power driver may not be used in the plurality of LED modules may be caused. Further, since each of the power drivers corresponding to each of the LED modules is provided, costs may be increased.

SUMMARY

Some embodiments of the present disclosure may provide a power driver for light emitting diode (LED) illumination and a control method thereof which may generally have a wide output voltage range by performing a skip mode control in a low voltage region of an output range of a DC/DC converter.

According to an exemplary embodiment of the present disclosure, a power driver for LED illumination may comprise a power correction unit receiving an AC voltage from the outside, rectifying the received AC voltage into a DC voltage, and correcting a power factor of the rectified DC voltage; and a DC/DC converter unit receiving the DC voltage from the power correction unit and converting the received DC voltage into a DC voltage which has a magnitude different from the received DC voltage and is supplied to an LED module. The DC/DC converter unit may comprise a skip control unit, to which a current flowing in the LED module driven by receiving an output from the DC/DC converter unit is fed back, to detect a magnitude of the current and to output a signal for a skip mode control depending on the detected magnitude of the current.

The DC/DC converter unit may include a DC/DC controller which feeds back with the current flowing in the LED module to detect the magnitude of the current and controls a current flowing in a primary side winding of a transformer included in the DC/DC converter unit depending on the detected magnitude of the current.

The skip control unit may be configured of a processor (IC) which may compare the feeding back current with a reference current and output the signal for the skip mode control to the DC/DC controller depending on the comparison result.

The skip control unit may include: a comparator receiving and comparing a voltage signal sensed by an auxiliary winding disposed at the primary wiring side of the transformer and a skip carrier signal generated from a skip carrier generator, and outputting a skip mode operation signal when the sensed voltage is lower than a skip carrier level; and an OR gate receiving and OR-operating an output signal from the comparator and a feedback signal from the LED module and outputting the signal for the skip mode control to the DC/DC controller.

The skip control unit may have a structure to receive a skip control signal from an external main control unit and transfer the received skip control signal to the DC/DC controller.

The power factor correction unit may be, for example, but not limited to, a boost converter.

The DC/DC converter unit may be, for instance, but not limited to, an inductor-inductor-capacitor (LLC) resonance converter.

According to another exemplary embodiment of the present disclosure, there may be provided a method of controlling a power driver for LED illumination including a power correction unit and a DC/DC converter unit. The method may comprises: receiving, by the power correction unit, an AC voltage from the outside, rectifying the received AC voltage into a DC voltage, and correcting a power factor of the rectified DC voltage; and receiving, by the DC/DC converter unit, the DC voltage from the power correction unit and converting the received DC voltage into a DC voltage which has a magnitude different from the received DC voltage and is supplied to an LED module. A skip control unit, which may be included in the DC/DC converter unit, may feed back with a current flowing in the LED module driven by receiving the output from the DC/DC converter unit to detect a magnitude of the current and output a signal for a skip mode control depending on the detected magnitude of the current.

The outputting of the signal for the skip mode control by the skip control unit may include: receiving and comparing, by a comparator, a voltage signal sensed by an auxiliary winding disposed at a primary side of a transformer and a skip carrier signal generated from a skip carrier generator, respectively, and outputting a skip mode operation signal when the sensed voltage is lower than a skip carrier level; and receiving and OR-operating, by an OR gate, an output signal from the comparator and a feedback signal from the LED module and outputting the signal for the skip mode control to the DC/DC controller.

The outputting of the signal for the skip mode control by the skip control unit may be performed by a method of directly receiving a skip control signal from an external main control unit by the skip control unit and transferring the received skip control signal to the DC/DC controller.

DESCRIPTION OF THE PREFERRED EMBODIMENTS

Terms and words used in the present specification and claims are not to be construed as a general or dictionary meaning, but are to be construed to meaning and concepts meeting the technical ideas of the present invention based on a principle that the inventors can appropriately define the concepts of terms in order to describe their own inventions in the best mode.

Throughout the present specification, unless explicitly described to the contrary, "comprising" any components will be understood to imply the inclusion of other elements rather than the exclusion of any other elements. A term "part", "module", "device", or the like, described in the specification means a unit of processing at least one function or operation and may be implemented by hardware or software or a combination of hardware and software.

Hereinafter, exemplary embodiments of the present disclosure will be described with reference to the accompanying drawings.

Figure 1:
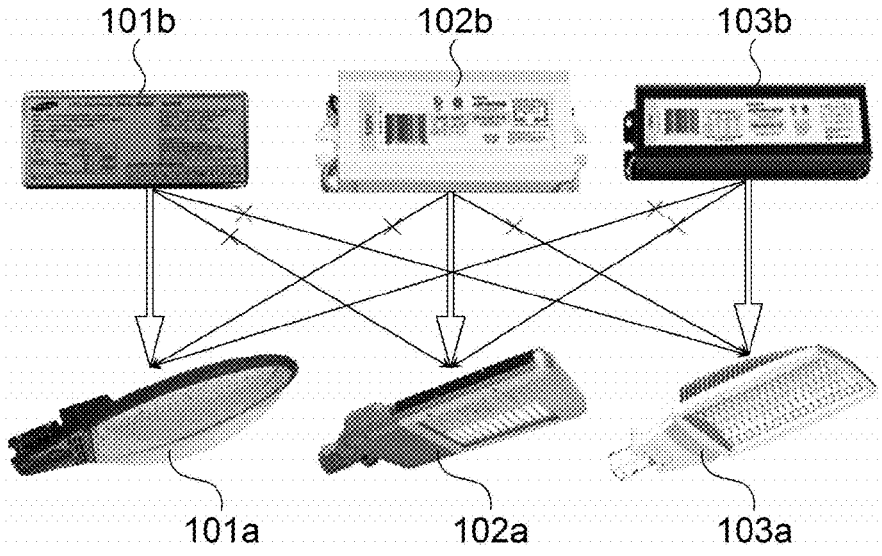
FIG. 1 is a diagram illustrating a state in which each of power drivers for illumination is used in a plurality of LED modules according to the related art.
Figure 9:
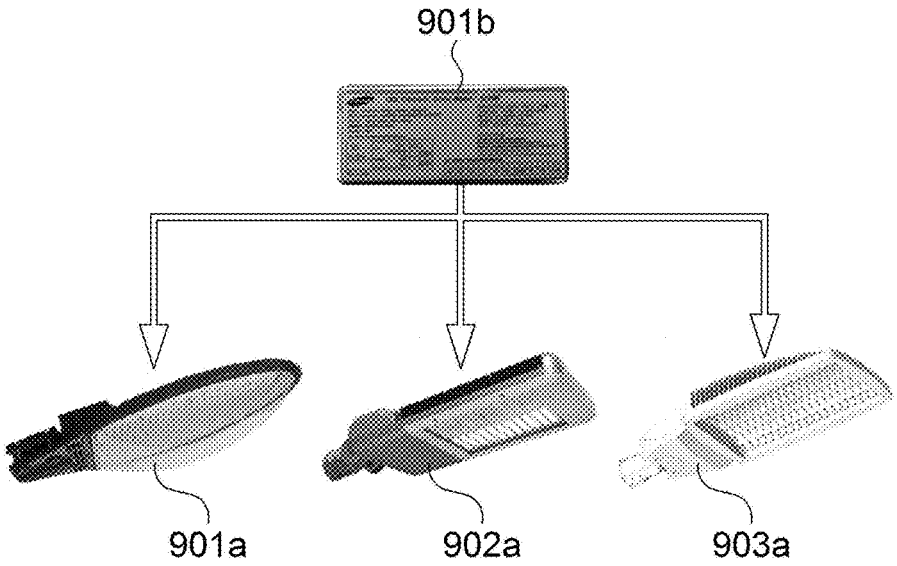
FIG. 9 is a diagram illustrating a state in which one power driver for LED illumination according to an exemplary embodiment of the present disclosure is used in the plurality of LED modules.

As illustrated in FIG. 1, in a power driver according to the related art, if an output voltage of power is narrow, each LED module may need different power drivers. Therefore, according to some exemplary embodiments of the present disclosure, as illustrated in FIG. 9, in order for one power driver 901*b* to be used in different LED modules 901*a* to 903*a*, the power driver 901*b* may need to have a wide range of the output voltage. However, the output voltage range of the power driver 901*b* may be determined by a transformer in a DC/DC conversion process, such that it is difficult to make the output voltage range wide. Generally, as illustrated in FIG. 10, a characteristic curve may be obtained by the designed transformer.

Figure 10:
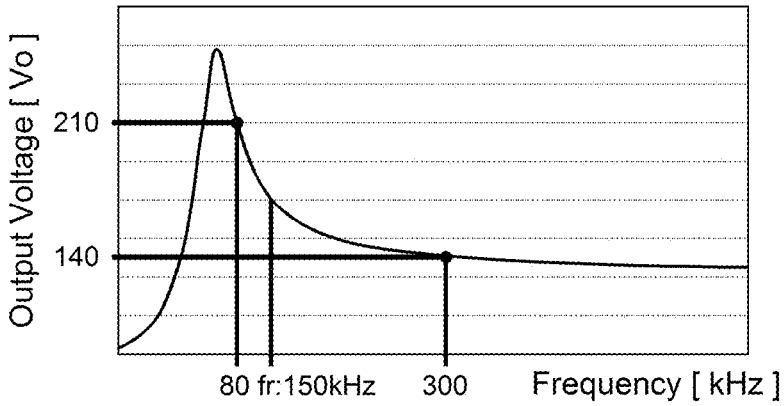
FIG. 10 is a diagram illustrating characteristics of an output voltage of a general DC/DC converter.

FIG. 10 illustrates the characteristic curve of a DC/CD converter (transformer). As illustrated in FIG. 10, a frequency range of the converter is 80 KHz to 300 KHz and an output voltage range corresponding thereto is DC 140V to 210V. However, in order to widen the output voltage range, a low voltage region (for example, below 140 V). According to the exemplary embodiment of the present disclosure, a skip mode control method may widen the output voltage range. Hereinafter, the exemplary embodiment of the present invention will be described in detail with reference to the skip mode control method.

Figure 2:
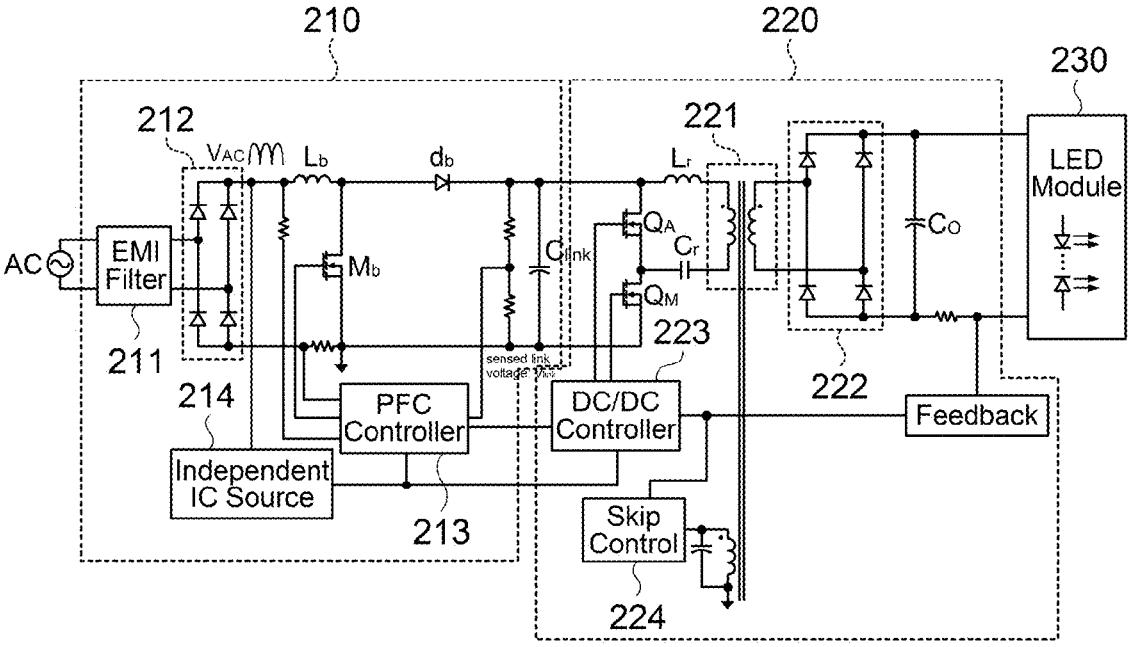
RELATED ART FIG. 2
FIG. 2 is a diagram schematically illustrating a configuration of a power driver for LED illumination according to an exemplary embodiment of the present disclosure.

FIG. 2 is a diagram schematically illustrating a configuration of a power driver for LED illumination according to an exemplary embodiment of the present disclosure.

Referring to FIG. 2, the power driver for LED illumination according to the exemplary embodiment of the present disclosure may be configured to include a power factor correction unit 210 and a DC/DC converter unit 220.

The power factor correction unit 210 may receive an AC voltage from an external AC power supply, rectify the received AC voltage into a DC voltage, and correct a power factor of the rectified DC voltage. The power factor correction unit 210 may comprise an electromagnetic interference (EMI) filter 211, a first bridge diode 212, a power factor correction (PFC) controller 213, and an IC power supply unit 214.

The EMI filter 211 may remove a high frequency noise component mixed in the external AC power supply. The first bridge diode 212 may rectify the AC voltage input through the EMI filter 211 into the DC voltage. The PFC controller 213 may correct a power factor of the DC voltage rectified by the first bridge diode 212 by controlling an inductance component of an inductor $L_b$ and a capacitance component of a capacitor $C_{link}$. The IC power supply unit 214 may supply a voltage acquired from an output terminal of the first bridge diode 212 to the power factor correction controller 213 and a DC/DC controller 223 as a driving power. For example, a boost converter may be used for the power factor correction unit 210. However, the present invention is not limited thereto, and therefore an apparatus or a circuit in another type having a power factor correction function may be used.

The DC/DC converter unit 220 may receive the DC voltage from the power factor correction unit 210, and may convert the received DC voltage into a DC voltage which may have a magnitude different from the received DC voltage and be supplied to the LED module 230. The DC/DC converter unit 220 may comprise a transformer 221, the second bridge diode 222, a DC/DC controller 223, and a skip control unit 224.

The transformer 221 may transform the DC voltage input via the power factor correction unit 210 into a DC voltage which may have a magnitude different from the DC voltage input. The second bridge diode 222 may rectify a DC voltage output from a secondary side winding of the transformer 221. The DC/DC controller 223 may control a turn on/off of semiconductor switch elements $Q_A$ and $Q_M$ (for example, MOSFET) to interrupt a flow of current in a primary side winding of the transformer 221. The skip control unit 224 may feed back with a current flowing in the LED module 230 driven by receiving the output from the DC/DC converter unit 220 to detect a magnitude of the current and output a signal for a skip mode control depending on the detected magnitude of the current. For instance, an inductor-inductor-capacitor (LLC) resonance converter may be used for the DC/DC converter unit 220. However, the present invention is not limited thereto, and therefore another type of apparatus or circuit having a DC/DC converter function may be used.

The DC/DC controller 223 may be configured to receive the current flowing in the LED module 230 as a feedback input to detect a magnitude of the current and to output the signal for controlling the current flowing in the primary side winding of the transformer 221 to the semiconductor switch elements $Q_A$ and $Q_M$ depending on the detected magnitude of the current.

Further, the skip control unit 224 may be configured of a processor (IC) which may compare the feed-back current with a reference current and output the signal for the skip mode control to the DC/DC controller 223 depending on the comparison result.

Figure 3:
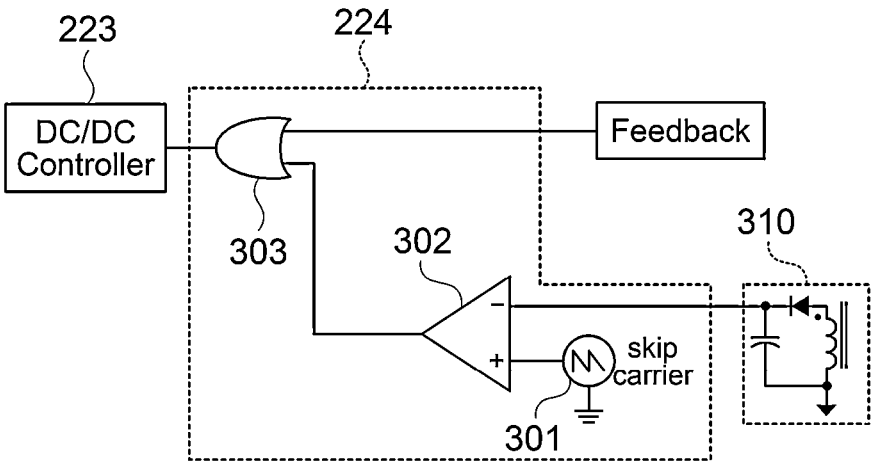
FIG. 3 is a diagram illustrating a configuration of a skip control unit in the power driver for LED illumination illustrated in FIG. 2.

For instance, as illustrated in FIG. 3, the skip control unit 224 may comprise a skip carrier generator 301, a comparator 302 and an OR gate 303. The comparator 302 may receive and compare a voltage signal sensed by the auxiliary winding 310 disposed at the primary side of the transformer 221 and a skip carrier signal generated from the skip carrier generator 301, respectively. The comparator 302 may output a skip mode operation signal when the sensed voltage is lower than the skip carrier level. The OR gate 303 may receive and OR-operate an output signal from the comparator 302 and the feedback signal from the LED module 230 and may output the signal for the skip mode control to the DC/DC controller 223.

Further, the skip control unit 224 may be configured of a structure to receive the skip control signal from an external main control unit (not illustrated) and transfer the received skip control signal to the DC/DC controller 223.

Herein, an operation relationship of the skip control unit 224 as described above will be briefly described with reference to FIG. 3.

Referring to FIG. 3, the skip carrier generator 301 may generate, for example, but not limited to, a sawtooth pulse signal as a skip carrier. The sawtooth pulse signal may be input to a non-inversion (+) terminal of the comparator 302. Further, the voltage sensed by the auxiliary winding 310 mounted at the primary side of the transformer 221 of the DC/DC converter unit 220 is input to an inversion (−) terminal of the comparator 302. The voltage sensed by the auxiliary winding 310 (hereinafter "sensed voltage") may correlate with or be proportional to a voltage to which an output voltage of the secondary side of the transformer 221 is projected. For example, in case of which the voltage of the auxiliary winding 310 is 20V when the output voltage of the secondary side is 200 V, if the output voltage of the secondary side falls to 100 V, the voltage of the auxiliary winding 310 proportionately falls to 10V.

The comparator 302 may compare a pulse signal (for example, skip carrier) level with the sensed voltage from the auxiliary winding 310 to operate the skip mode operation when the sensed voltage falls below the pulse signal (e.g. skip carrier) level. Further, when the OR gate 303 receives a feedback control signal and then receives the output signal, that is, the skip carrier signal of the comparator 302, the OR gate 303 may output a signal for the skip mode control is output to the DC/DC controller 223. Therefore, the DC/DC controller 223 may perform the skip control operation.

Next, the control method of the power driver for LED illumination according to exemplary embodiments of the present disclosure will be described below.

Figure 4:
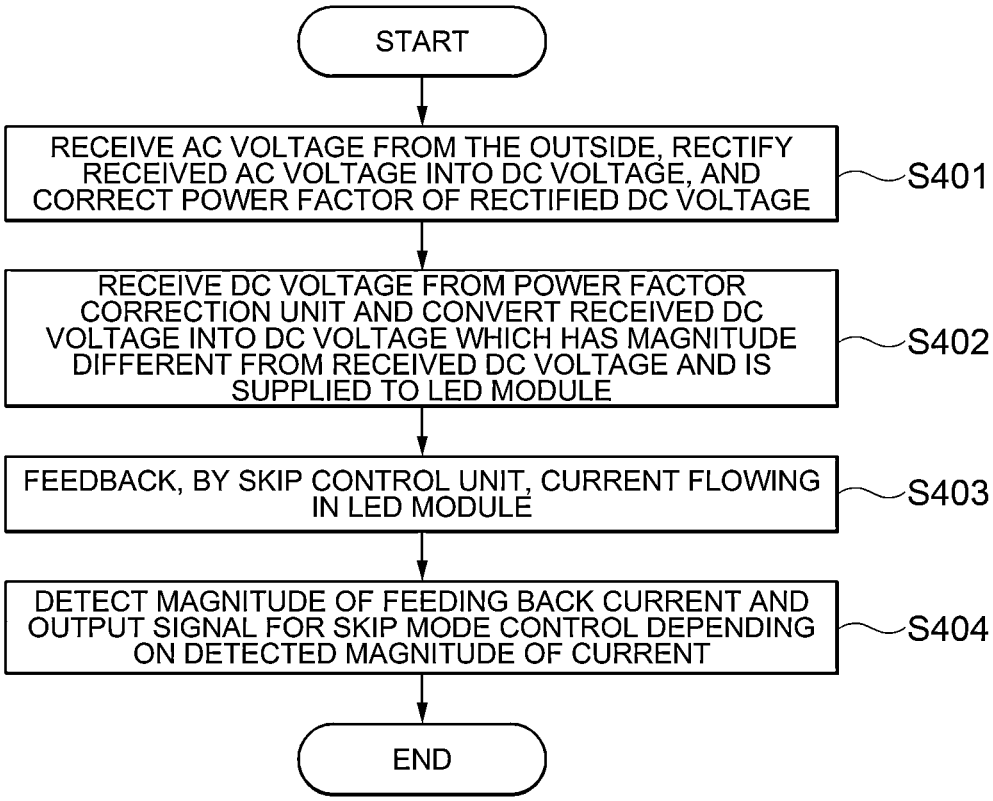
FIG. 4 is a flow chart illustrating a method of controlling a power driver for LED illumination according to an exemplary embodiment of the present disclosure.

FIG. 4 is a flow chart illustrating a process of executing a method of controlling a power driver for LED illumination according to an exemplary embodiment of the present disclosure.

Referring to FIG. 4, a control method of a power driver for LED illumination according to the exemplary embodiment of the present invention may be the control method of the power driver for LED illumination described above. For example, the power driver may comprise the power factor correction unit 210 and the DC/DC converter unit 220. The power driver may receive the AC voltage from the outside by the power factor correction unit 210, rectify the received AC voltage into the DC voltage, and correct the power factor of the rectified DC voltage (step S401). That is, the inductance component of the inductor $L_b$ and the capacitance component of the capacitor $C_{link}$ may be controlled by the power factor correction (PFC) controller 213 of the power factor correction unit 210, thereby correcting the power factor of the DC voltage rectified by the first bridge diode 212.

When the power factor correction is completed, the DC/DC converter unit 220 may receive the DC voltage from the power factor correction unit 210 and may convert the received DC voltage into a DC voltage which may have a magnitude different from the received DC voltage and may be supplied to the LED module 230 (step S402). For instance, the DC/DC converter unit 220 may output the DC voltage having the magnitude different from the DC voltage input to the primary side winding of the transformer 221 through the secondary side winding of the transformer 221 depending on a turn ratio of the primary and secondary side of the transformer 221 of the DC/DC converter unit 220. The LED module 230 may be driven by being applied with the DC voltage output from the DC/DC converter unit 220.

When the LED module 230 is driven, the skip control unit 224, which is disposed or included in the DC/DC converter unit 220, may receive a feedback input which may be the current flowing in the LED module 230 driven by receiving the output from the DC/DC converter unit 220 (step S403).

The skip control unit 224 may detect the magnitude of the feed-back current and may output the signal for the skip mode control depending on the detected magnitude of the current (step S404).

Herein, the process of outputting the signal for the skip mode control by the skip control unit 224 will be additionally described with reference to FIG. 5.

Figure 5:
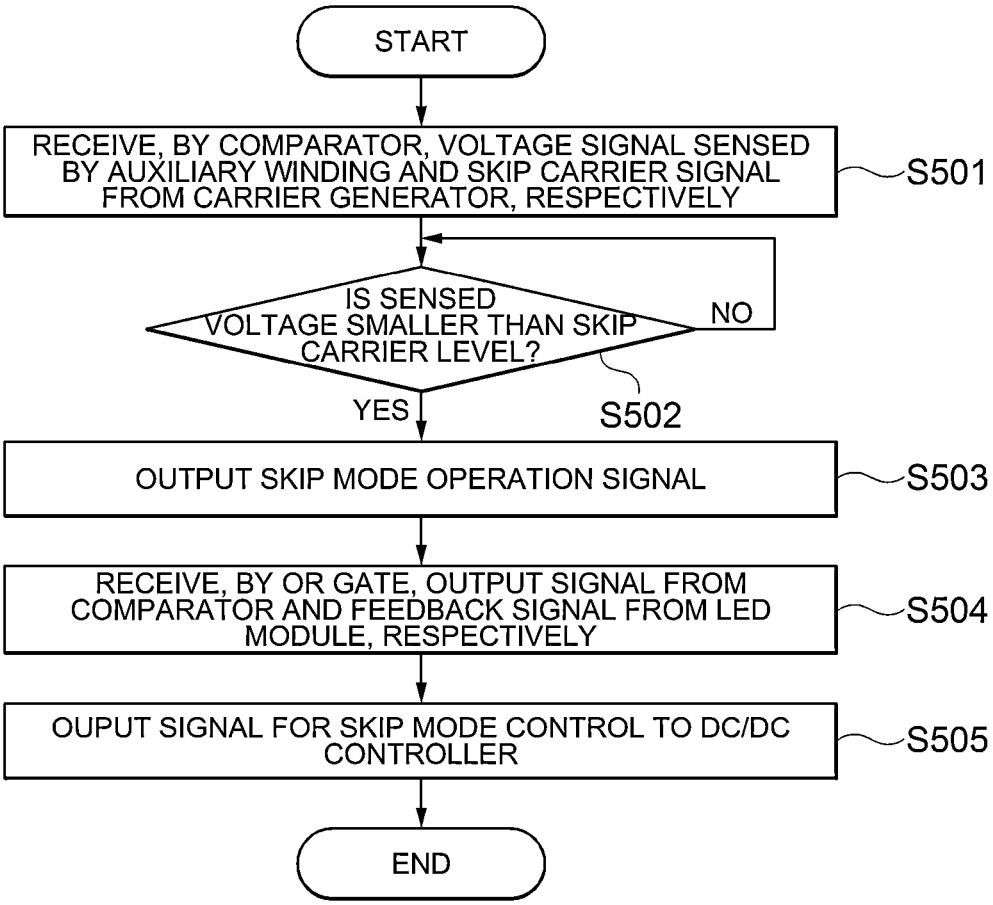
FIG. 5 is a flow chart illustrating a process of outputting a signal for a skip mode control by a skip control unit according to an exemplary embodiment of the present disclosure.

FIG. 5 is a flow chart illustrating the process of outputting the signal for the skip mode control by the skip control unit 224.

Referring to FIG. 5, the comparator 302 may receive the voltage signal sensed by the auxiliary winding 310 mounted at the primary side of the transformer 221 which is disposed in the DC/DC converter unit 220 (hereinafter "sensed voltage") the skip carrier signal generated from the skip carrier generator 301 (step S501), and may determine whether the sensed voltage is less than the level of the skip carrier (step S502).

In the determining of the step 5502, if it is determined that the sensed voltage is not smaller than the skip carrier level, the comparator 302 may not output any signal at all. Therefore, the DC/DC controller 223 may perform the usual (general) control according to the input of the feedback signal. Further, in the determining of the step S502, if it is determined that the sensed voltage is smaller than the skip carrier level, the comparator 302 may output the skip mode operation signal (step S503).

When the skip mode operation signal is output by the comparator 302, the OR gate 303 may receive and OR-operate the output signal from the comparator 302 and the feedback signal from the LED module 230 (step S504). When acquiring the skip mode operation signal by receiving the feedback signal and the skip mode operation signal, the comparator 302 may output the signal for the skip mode control to the DC/DC controller 223 (step S505).

As described above, outputting the signal for the skip mode control by the skip control unit 224 may be implemented by the method of directly receiving the skip control signal from the external main control unit (not illustrated) by the skip control unit 224 and transferring the received skip control signal to the DC/DC controller 223.

Figure 6:
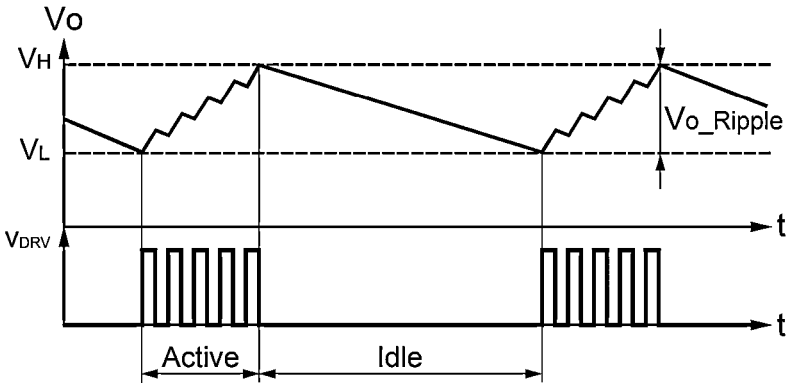
FIG. 6 is a diagram illustrating a skip mode control adopted in an exemplary embodiment of the present disclosure in a form of an output voltage pulse signal.

Meanwhile, FIG. 6 is a diagram illustrating the skip mode control adopted in the exemplary embodiment of the present disclosure in a form of an output voltage pulse signal.

Herein, briefly describing the definition and the basic concept of the 'skip mode control' with reference to FIG. 6, the skip mode control may mean that the control to apply a gate driving voltage pulse signal $V_{DRV}$ from the DC/DC controller 223 of the DC/DC converter unit 220 to the switch elements $Q_A$ and $Q_M$ for a predetermined time and then stop the application of the driving voltage pulse signal for a predetermined time and again apply the driving voltage pulse signal for a predetermined time and then stop the application of the driving voltage pulse signal for a predetermined time is repeatedly performed. When the above control is performed, the characteristic that the voltage is dropped in the low voltage region among the output voltage of the transformer 221 may be changed to a characteristic that the voltage smoothly falls over a longer period of time. In FIG. 6, the $V_{DRV}$ represents the gate driving voltage pulse signal applied from the DC/DC controller 223 to the switch elements $Q_A$ and $Q_M$, $V_O$ represents the output voltage from the secondary side winding of the transformer 221, $V_H$ represents a highest value of the output voltage, and $V_L$ represents a lowest value of the output voltage.

Figure 8:
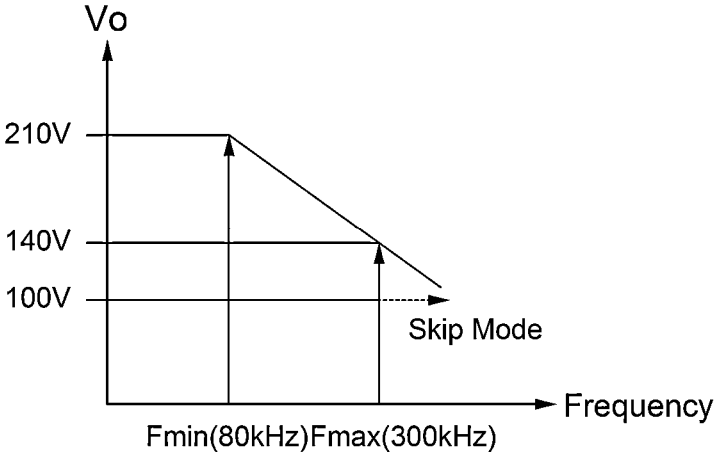
FIG. 8 is a diagram illustrating a wide output voltage range of the power driver for LED illumination according to the exemplary embodiment of the present disclosure.

When the skip mode control is performed in the low voltage region of the output voltage of the transformer 221 as illustrated in FIG. 6, as illustrated in FIG. 8, the output voltage range may be controlled to widen from a range between 140 and 210V of the related art to a range between 100 and 210V or the lower voltage may be controlled to DC 100V or less (see FIG. 8). According to the exemplary embodiment of the present invention, the reason of performing the skip mode control in the low voltage region is that the voltage control may be difficult due to the characteristic that in the high voltage ($V_H$) region, the voltage suddenly rises and then suddenly falls, while the voltage control is relatively easier due to the characteristic that in the low voltage ($V_L$) region the voltage smoothly falls and thus the voltage may be controlled over a wide range.

Figure 7:
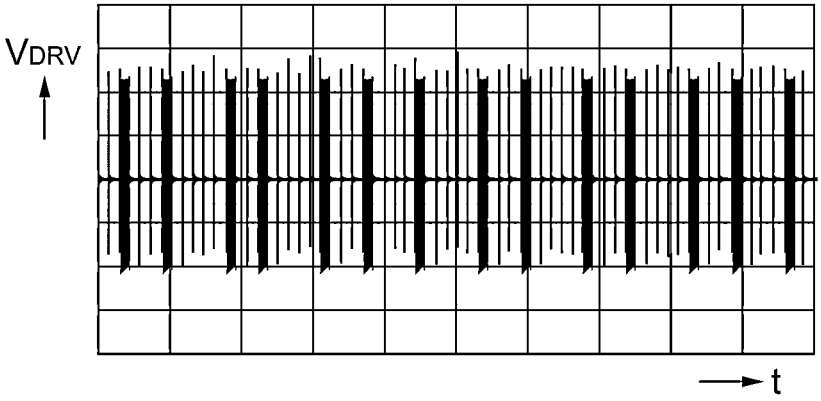
FIG. 7 is a diagram illustrating an actual pulse waveform input to a gate of a switch element at the time of the skip mode control in a low voltage region according to the exemplary embodiment of the present disclosure.

FIG. 7 is a diagram illustrating an actual pulse waveform input to a gate of a switch element at the time of the skip mode control in a low voltage region according to the control method of the exemplary embodiment of the present disclosure.

As illustrated in FIG. 7, the actual pulse waveforms input to the gates of the switch elements $Q_A$ and $Q_M$ at the time of the skip mode control operation may be alternately represented repeatedly. When the skip control is performed, as described above, the voltage output from the transformer 221 may have a wide output voltage range.

As described above, according to some exemplary embodiments of the present disclosure, to commonly use the LED illumination power, the control method (skip control) may have the wide output voltage range, such that one power driver may be used in the plurality of LED illumination module.

As described above, the power driver for LED illumination and the control method thereof according to some exemplary embodiments of the present disclosure may generally have the wide output voltage range by performing the skip mode control in the low voltage region of the output range of the DC/DC converter (transformer), such that one power driver may be used in the plurality of different LED lighting devices. Therefore, costs required for the power driver may be reduced.

According to some exemplary embodiments of the present disclosure, the wide output voltage range may be generally implemented by performing the skip mode control in the low voltage region of the output range of the DC/DC converter (transformer), such that one power driver may be used in the plurality of different LED lighting devices.

Although exemplary embodiments of the present invention have been disclosed for illustrative purposes, the present invention is not limited thereto, but those skilled in the art will appreciate that various modifications, additions and substitutions are possible, without departing from the scope and spirit of the invention as disclosed in the accompanying claims. Therefore, the protection scope of the present invention must be analyzed by the appended claims and it should be analyzed that all spirits within a scope equivalent thereto are included in the appended claims of the present disclosure.

What is claimed is:

1. A power driver for Light Emitting Diode (LED) illumination, comprising:

a power correction unit receiving an AC voltage, rectifying the received AC voltage into a DC voltage, and correcting a power factor of the rectified DC voltage; and a DC/DC converter unit receiving the DC voltage from the power correction unit and converting the received DC voltage into a DC voltage which has a magnitude different from the received DC voltage and is supplied to an LED module, wherein the DC/DC converter unit comprises a skip control unit, to which a current flowing in the LED module driven by receiving an output from the DC/DC converter unit is fed back, to detect a magnitude of the current and to output a signal for a skip mode control depending on the detected magnitude of the current.

2. The power driver for LED illumination according to claim 1, wherein the DC/DC converter unit includes a DC/DC controller feeding back with the current flowing in the LED module to detect the magnitude of the current and controling a current flowing in a primary side winding of a transformer comprised in the DC/DC converter unit depending on the detected magnitude of the current.

3. The power driver for LED illumination according to claim 2, wherein the skip control unit comprises a processor comparing the fed back current with a reference current and outputting the signal for the skip mode control to the DC/DC controller depending on the comparison result.

4. The power driver for LED illumination according to claim 2, wherein the skip control unit includes:

a comparator receiving and comparing a voltage signal sensed by an auxiliary winding disposed at the primary side wiring of the transformer and a skip carrier signal generated from a skip carrier generator, and outputting a skip mode operation signal when the sensed voltage is lower than a skip carrier level; and an OR gate receiving and OR-operating an output signal from the comparator and a feedback signal from the LED module and outputting the signal for the skip mode control to the DC/DC controller.

5. The power driver for LED illumination according to claim 2, wherein the skip control unit receives a skip control signal from an external main control unit and transfers the received skip control signal to the DC/DC controller.

6. The power driver for LED illumination according to claim 1, wherein the power correction unit comprises a boost converter.

7. The power driver for LED illumination according to claim 1, wherein the DC/DC converter unit comprises an inductor-inductor-capacitor (LLC) resonance converter.

8. A method of controlling a power driver for LED illumination including a power correction unit and a DC/DC converter unit, the method comprising:

receiving, by the power correction unit, an AC voltage, rectifying the received AC voltage into a DC voltage, and correcting a power factor of the rectified DC voltage;

receiving, by the DC/DC converter unit, the DC voltage from the power correction unit and converting the received DC voltage into a DC voltage which has a magnitude different from the received DC voltage and is supplied to an LED module;

feeding a current, which flows in the LED module driven by receiving an output from the DC/DC converter unit, back to a skip control unit comprised in the DC/DC converter unit; and detecting a magnitude of the current and outputting a signal for a skip mode control depending on the detected magnitude of the current, by the skip control unit.

9. The method according to claim 8, wherein the outputting of the signal for the skip mode control by the skip control unit includes:

receiving and comparing, by a comparator, a voltage signal sensed by an auxiliary winding disposed at a primary side of a transformer and a skip carrier signal generated from a skip carrier generator, and outputting a skip mode operation signal when the sensed voltage is lower than a skip carrier level; and receiving and OR-operating, by an OR gate, an output signal from the comparator and a feedback signal from the LED module and outputting the signal for the skip mode control to the DC/DC controller.

10. The method according to claim 8, wherein the outputting of the signal for the skip mode control by the skip control unit comprises:

directly receiving a skip control signal from an external main control unit by the skip control unit; and transferring the received skip control signal to the DC/DC controller.

* * * * *